United States Patent [19]

DeBlaay

[11] Patent Number: 4,925,255

[45] Date of Patent: May 15, 1990

[54] FURNITURE CONSTRUCTIONS INCLUDING HIDDEN COMPARTMENTS

[75] Inventor: William E. DeBlaay, Manlius, N.Y.

[73] Assignee: L & JG Stickley, Manlius, N.Y.

[21] Appl. No.: 293,986

[22] Filed: Jan. 6, 1989

[51] Int. Cl.[5] ..... A47B 17/04

[52] U.S. Cl. ..... 312/204; 312/320; 49/463

[58] Field of Search ..... 312/204, 257 A, 320, 312/351, 319; 108/60; 49/463

[56] References Cited

U.S. PATENT DOCUMENTS

| | | | |
|---|---|---|---|
| 2,362,017 | 11/1944 | May | 312/204 |
| 2,939,187 | 6/1960 | Hilgendorf | 49/415 |
| 3,129,987 | 4/1964 | Hill | 312/204 |
| 3,278,145 | 10/1966 | Leshuk | 248/221.3 |
| 3,503,641 | 3/1970 | Fraser | 248/221.3 X |
| 3,999,824 | 12/1976 | Pearson | 312/204 X |
| 4,261,122 | 4/1981 | LeVine | 312/204 X |
| 4,715,669 | 12/1987 | Baillie et al. | 312/319 X |

*Primary Examiner*—Joseph Falk

*Attorney, Agent, or Firm*—Charles S. McGuire

[57] ABSTRACT

Furniture pieces of the type normally having internal compartments, are provided with hidden compartments for effective concealment of relatively small but valuable articles. A number of constructional variations are disclosed, each including a removable panel member having opposite edge portions which may be positioned in grooves provided in fixed portions of the furniture piece. Spring means in one of the grooves bias the panel member to a stationary position. Handle means are affixed to the panel member for ease of placement in and removal from the grooves. The panel member and handle means have the appearance of other, conventional parts of the furniture piece and, when the panel member is positioned in the grooves, the compartment which it covers is essentially undiscernable, and therefore undetectable to those unaware of its presence.

2 Claims, 4 Drawing Sheets

FURNITURE CONSTRUCTIONS INCLUDING HIDDEN COMPARTMENTS

BACKGROUND OF THE INVENTION

The present invention relates to items of furniture such as buffets, dressers, desks, and the like, being more specifically concerned with furniture constructions which include one or more compartments having closure and access means which are not visually discernable as such.

When a dwelling or other structure is burglarized the most likely targets of theft are those having relatively small size and weight, but high monetary value. For obvious reasons, a thief is more inclined to take jewelry, flatware or other items of sterling or other precious metals, cash, etc., in favor of larger and heavier items which are more difficult to transport and conceal. It is a common practise for burglars to empty and search through the contents of drawers, shelves and other compartments of furniture as a location is burglarized. Safes or vaults which are logically expected to contain valuable items are opened by any of a number of means. Thus, there exists a need for means to conceal small, valuable items in locations which are not normally discernable to a potential thief.

It is a principal object of the present invention to provide hidden compartments which are incorporated into items of furniture in such a way as to be easily accessible to an individual knowing the location of and means of access to the compartments, but which are not normally discernable to others.

Another object is to provide items of furniture having hidden compartments of relatively simple design and construction, suitable for temporary storage and concealment of valuables, wherein the external appearance of the compartment closure is substantially the same as that of conventional furniture components.

Other objects will in part be obvious and will in part appear hereinafter.

SUMMARY OF THE INVENTION

In accordance with the foregoing objects, the invention contemplates items of furniture which include one or more rectangular panels which serve as removable closures for compartments wherein relatively small, valuable articles, including jewelry, flatware, documents, and the like, may be effectively concealed. Opposite edge portions of the panels, are removably supported in parallel grooves in opposing, spaced walls within an internal compartment of the furniture. The grooves are equally spaced from a stationary end wall of the compartment. One or more leaf springs, positioned in one of the grooves or elsewhere, resiliently urges the removable panel to a stationary position. Handle means are connected to the panel for ease of placement in and removal from the position wherein it closes the compartment. The appearance of both the panel and handle means is such that they are perceived as permanent, fixed portions of the furniture when in the closure position. The invention is disclosed in a number of embodiments, incorporated in various items of furniture.

The foregoing and other features of the invention will be more readily understood and fully appreciated from the following detailed description, taken in conjunction with the accompanying drawings.

DETAILED DESCRIPTION

Figure 1:
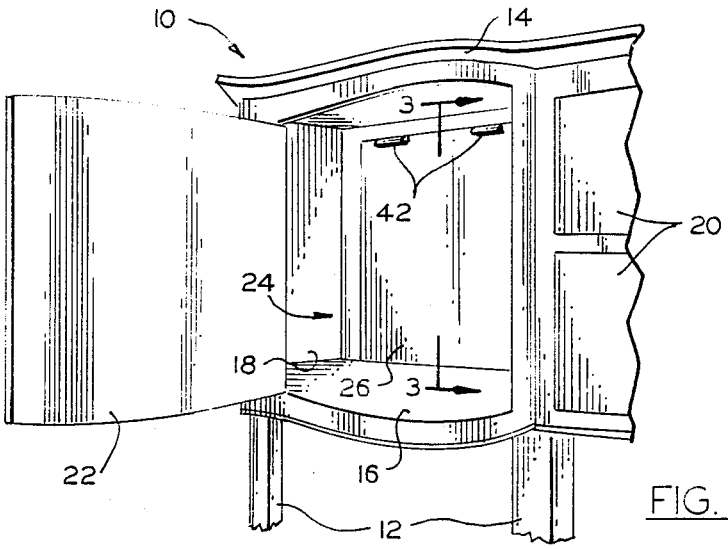
FIG. 1 is a fragmentary, perspective view of a piece of furniture incorporating the hidden compartment of the present invention.
Figure 2:
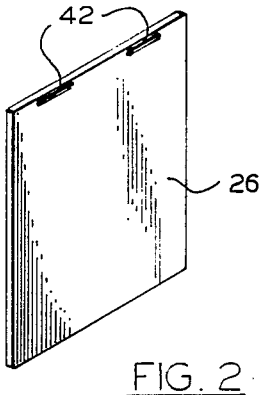
FIG. 2 is a perspective view of an element of the furniture item of FIG. 1.
Figure 3:
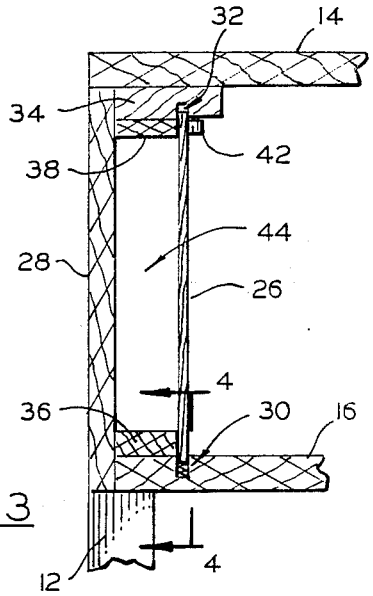
FIG. 3 is a fragmentary, side elevational view of a portion of the furniture item, in section taken generally on the line 3—3 of FIG. 1.

Referring now to the drawings, the invention is illustrated in a first embodiment or constructional variation in FIGS. 1–4, incorporated in a furniture piece in the form of a dining room buffet designated generally by reference numeral 10. Buffet 10 is supported on legs 12 and includes top, bottom and side walls 14, 16 and 18, respectively, a plurality of drawers 20 and hinged door 22, the latter serving as a closure for compartment 24, all of conventional construction. As seen in FIG. 1, the rear wall of compartment 24 is provided by panel member 26, although rear wall 28 of buffet 10, as seen in FIG. 3, is spaced from panel member 26.

Figure 4:
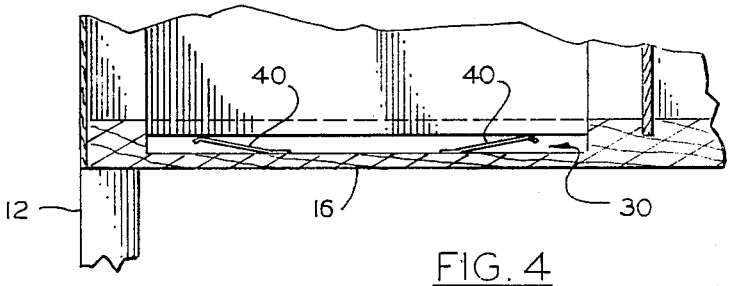
FIG. 4 is a fragmentary, front elevational view in section on the line 4—4 of FIG. 3.

Lower groove 30, having a width and thickness corresponding substantially to the width and thickness of panel member 26, extends laterally across bottom wall 16, parallel to and spaced forwardly of rear wall 28. Upper groove 32, of the same width and thickness as groove 30 and spaced by the same distance from rear wall 28, is provided in block 34 which is permanently secured within compartment 24 along the upper, rear side thereof. Lower and upper blocks 36 and 38, respectively, are secured to lower wall 16 and block 34 to extend between rear wall 28 and forwardly facing surfaces flush with lower and upper grooves 30 and 32, respectively. Leaf springs 40 are permanently anchored in groove 30, as best seen in FIG. 4.

The vertical length of panel member 26 is greater than the distance between opposing surfaces of wall 16 and block 34, but less than the distance between the bottom of groove 30 and the opposing surface of block 34. Thus, the lower edge of panel member 26 may be placed within groove 30, and downward pressure exerted on the panel member to compress springs 40, permitting the upper edge of the panel member to be placed in alignment with groove 32. Upon release of the downward pressure, springs 40 will urge panel member 26 upwardly, engaging the upper edge thereof in groove 32, as shown in FIG. 3.

Glue blocks 42 are affixed to the forwardly facing surface of panel member 26, parallel to and spaced a short distance downwardly from the upper edge thereof. Blocks 42 serve as handle means which may be manually grasped as panel member 26 is placed in grooves 30 and 32 as described above, as well as to apply downward pressure to the panel member to remove the upper edge from groove 32 and permit removal of the panel member from compartment 24. When panel member 26 is positioned with its lower and upper edges in grooves 30 and 32, respectively, it is urged upwardly so that glue blocks 42 abut against block 34, and the spaced relationship of panel member 26 and rear wall 28 provide hidden compartment 44 rearwardly of compartment 24. When viewing the interior of compartment 24, panel member 26 appears to be a permanently installed rear wall, glue blocks 44 appearing to be of the type conventionally provided to fixedly secure panel 26 and block 34. Thus, to anyone unaware of the removability of panel member 26, the presence of hidden compartment 44 is essentially undiscernable.

Turning now to the construction of FIGS. 5–8, the invention is illustrated in conjunction with upper portions of a piece of furniture such as a desk or secretary, denoted by reference numeral 46. Included in the upper structure of furniture piece 46 is a compartment divided into upper and lower portions 48 and 50, respectively, by removable shelf 52. Door 54 provides a hinged front closure for both the upper and lower portions of the compartment. Shelf 52 is supported upon, but not attached to, support members 56, 58 and 60, fixedly attached to side walls 62 and 64 and panel member 66, respectively.

Figure 5:
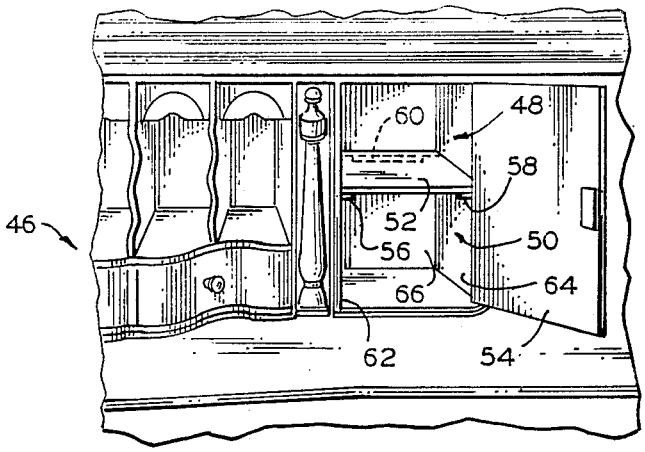
FIG. 5 is a fragmentary, perspective view of another piece of furniture incorporating the invention in a second embodiment.
Figure 6:
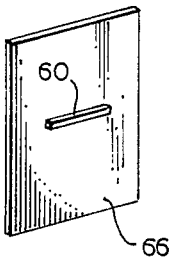
FIG. 6 is a perspective view of an element of the FIG. 5 construction.
Figure 7:
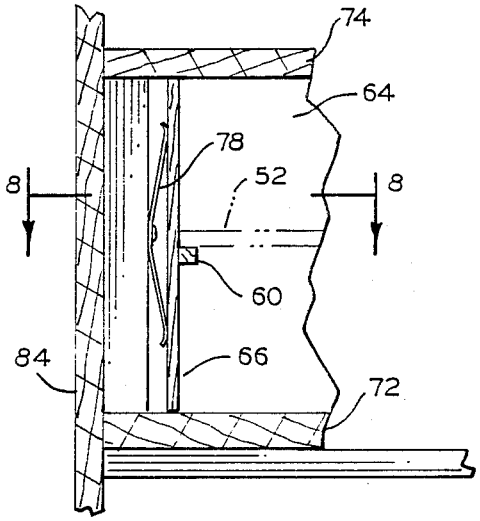
FIG. 7 is a fragmentary, side elevational view of a rear portion of the furniture piece of FIG. 5, in vertical section.
Figure 8:
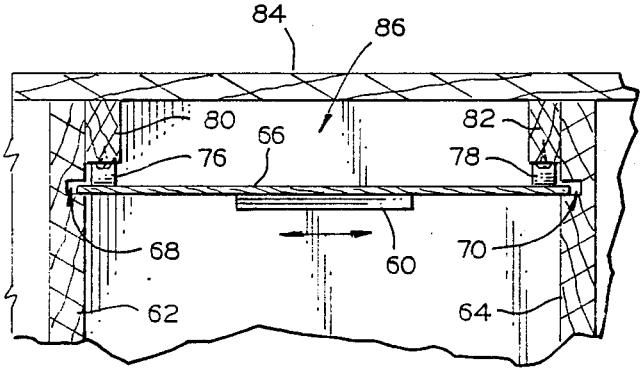
FIG. 8 is a fragmentary, plan view in section on the line 8—8 of FIG. 7.

As seen in FIG. 8, grooves 68 and 70 are formed in side walls 62 and 64, respectively, and extend between lower and upper walls 72 and 74, respectively. Leaf springs 76 and 78 are fixedly attached at their midpoints to blocks 80 and 82 which, in turn, are glued or otherwise affixed to side walls 62 and 64 and/or rear wall 84. The width of panel member 66 is greater than the distance between side walls 72 and 74, but less than the distance between the bottoms of grooves 68 and 70. Thus, one of the vertical, side edges of panel member 66 may be placed in one of grooves 68 and 70, an inward or rearward force exerted on the panel to deflect springs 76 and 78, and the panel moved laterally to engage the other edge in the other groove. Panel member 66 will be biased by springs 76 and 78 into firm engagement with the frontward surfaces of grooves 68 and 70. Shelf 52 may then be placed on support members 56, 58 and 60, as shown in FIG. 5.

Placement of panel member 66 as described above provides a secret or hidden compartment 86 between the actual rear wall 84 of the furniture piece, and removable panel member 66. To one observing the interior of the compartment behind door 54, panel member 66 appears to be a permanently installed, fixed wall. Support member 60, while providing handle means for insertion and removal of panel member 66, appears to be a normal support for the removable shelf.

Figure 9:
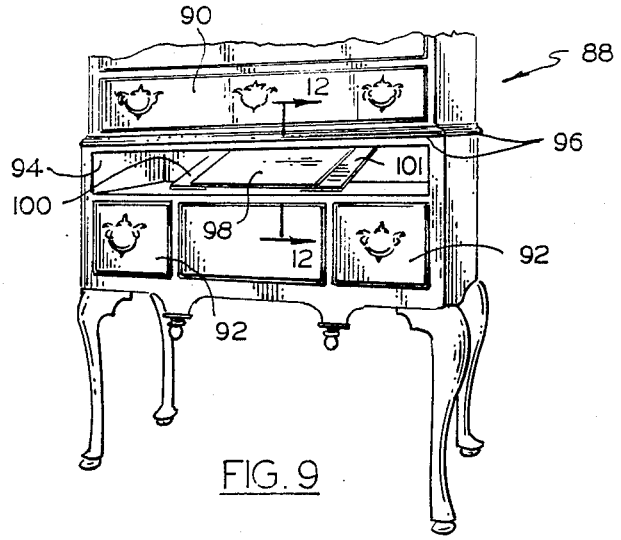
FIG. 9 is a perspective view of a third piece of furniture incorporating the invention in another constructional variation, showing a removable element thereof in a partially withdrawn position.

In FIG. 9 is shown the lower portion of a furniture piece in the form of a standing buffet or highboy 88 having an upper section with doors and/or drawers, one of which is denoted by reference numeral 90, and a lower section having doors and/or drawers 92. Between the upper and lower sections, extending the full width of buffet 88, is opening 94 for a sliding drawer which has been removed and is not shown in the drawing. Decorative moulding 96 is positioned between the upper section and the central drawer space on the front and sides of the buffet. Panel member 98, having flat strips 100 and 101 affixed to and extending outwardly from the side edges thereof, is shown in FIG. 9 extending partially into central drawer opening 94, as it would appear when being placed in or removed from a position within buffet 88, as explained below.

Figure 10:
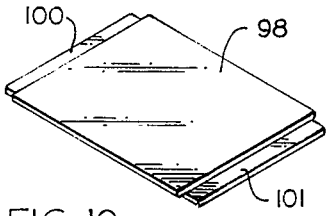
FIG. 10 is a perspective view of the removable element of the furniture item of FIG. 9, as seen from one side.
Figure 11:
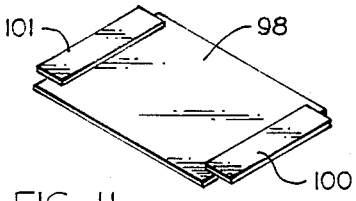
FIG. 11 is a perspective view of the element of FIG. 10, as seen from the opposite side.
Figure 12:
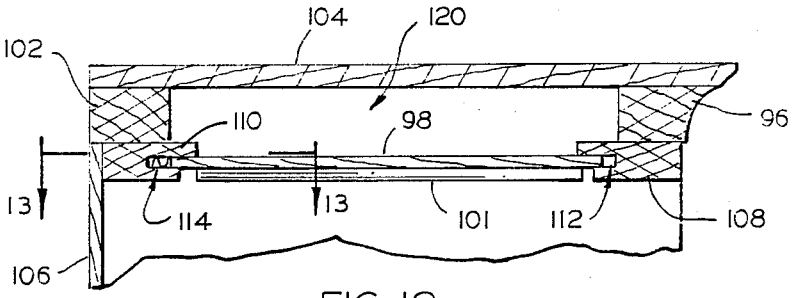
FIG. 12 is a fragmentary, side elevational view of a portion of the furniture item of FIG. 9, in section on the line 12—12 thereof.
Figure 13:
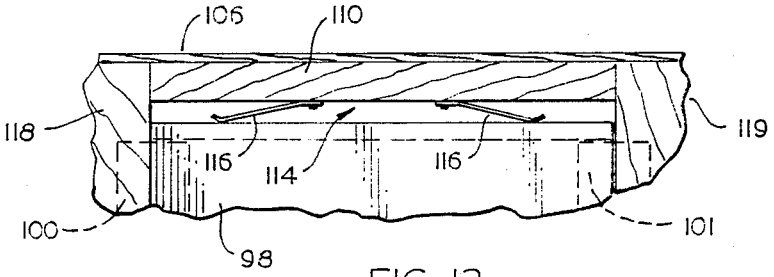
FIG. 13 is a fragmentary, plan view in section on the line 13—13 of FIG. 12.
Figure 14:
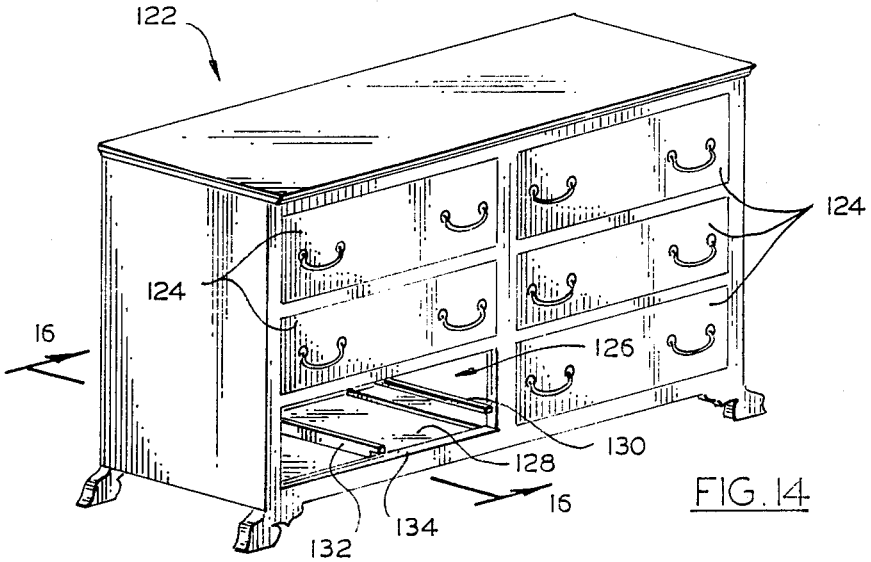
FIG. 14 is a perspective view of a fourth piece of furniture incorporating the invention in a further variation.
Figure 15:
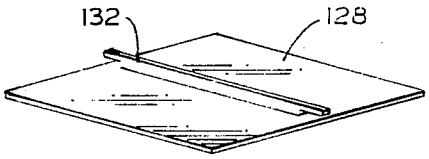
FIG. 15 is a perspective view of one of the elements of the iture item of FIG. 14.

Panel member 98 is shown from both its upper and lower sides in FIGS. 10 and 11, where it will be noted that strips 100 and 101 do not extend the full length of the side edges of panel member 98. As seen in FIG. 12, block 102 extends across the back of the buffet 88, between bottom wall 104 of the upper section of the furniture piece and rear wall 106 of central drawer space 94. Front and rear dust panel supports 108 and 110, respectively, are affixed to lower surfaces of moulding 96 and block 102, and each extend the full width of buffet 88. Opposing surfaces of supports 108 and 110 are provided with grooves 112 and 114, respectively, in central portions thereof. Leaf springs 116 are each affixed at one end within groove 114, as shown in FIG. 13.

The front-to-rear length of panel member 98 is greater than the distance between opposing surfaces of panel supports 108 and 110, but less than the distance between the bottoms of grooves 112 and 114. Thus, panel member 98 may be inserted into drawer space 94, as shown in FIG. 9, and the rear, lateral edge placed in groove 114. A rearward force is applied to the panel member, using strips 100 and 101 as handle means, compressing springs 116 to permit insertion of the forward, lateral edge of panel member 98 in groove 112. The forward bias of springs 116 urges strips 100 and 101 into abutment with support 108. In this position, panel member 98 appears to be a permanently installed dust panel, just as fixed panel members 118 and 119 on each side thereof. Strips 100 and 101, although actually providing handle means for insertion and removal of panel member 98, appear to be fixed to panel members 118 and 119, as well as to panel member 98 to cover the adjacent edges of the dust panels, as would normally be done in high quality furniture construction. Thus, the presence of and means of access to compartment 20 are essentially undiscernable to those unaware of its existence.

Turning now to FIGS. 14–18, a furniture piece in the form of a bedroom dresser 122 is shown. Dresser 122 includes a plurality of slidable and removable drawers 124, one of which has been removed from the space 126 which it normally occupies. Dust panels and both side and center drawer guides are provided within each drawer space, in accordance with conventional constructions of such furniture. Panel member 128 and side and center drawer guides 130 and 132, respectively, are shown within drawer space 126. Although the dust panels within the other drawer spaces are fixed, panel member 128 is removable to provide access to an otherwise hidden compartment, as explained below.

Figure 16:
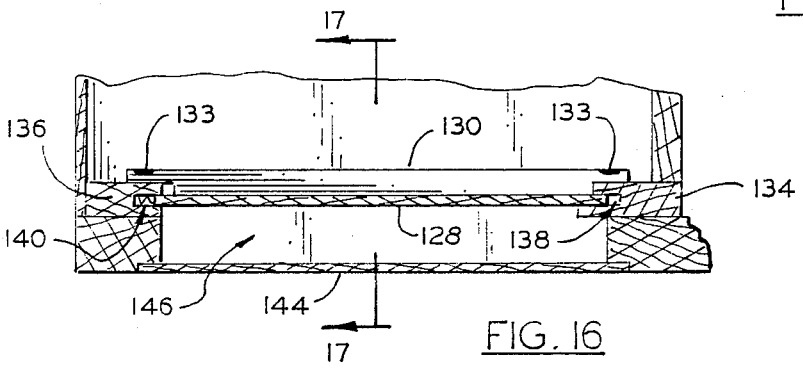
FIG. 16 is a fragmentary, side elevational view in section on the line 16—16 of FIG. 14.
Figure 17:
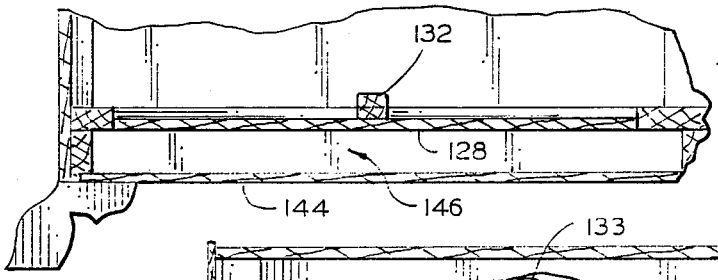
FIG. 17 is a fragmentary, front elevation view in section on the line 17—17 of FIG. 16.
Figure 18:
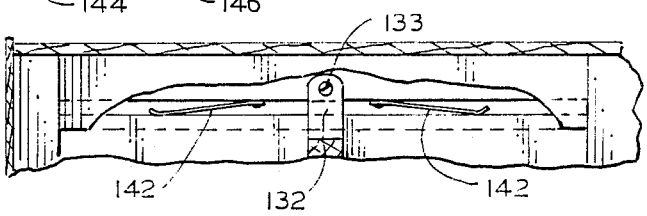
FIG. 18 is a fragmentary, plan view, with portions broken away, of portions seen in FIGS. 16 and 17.

Front and rear support members 134 and 136, respectively, extend laterally across the front and rear sides of dresser 122, and opposing surfaces thereof are provided with grooves 138 and 140, respectively, as shown in FIG. 16. Leaf springs 142 are affixed within groove 140, as best seen in FIG. 18. As in the previously described embodiments, panel member 128 has a length permitting insertion of the forward and rear lateral edges thereof in grooves 138 and 140, with springs 142 exerting a forward bias. Center drawer guide 132 is notched at each end, as are the other center drawer guides, to extend over support members 134 and 136. All center drawer guides other than 132 are affixed to the corresponding support members by wood screws extending through the overlying portions at each end of the center guides. Accordingly, screw heads 133, as seen in FIGS. 16 and 18, are glued in openings in guide 132 to add to the illusion that panel 128 is permanently installed. Lower wall 144 is fixedly positioned in parallel, spaced relation to panel member 128, as seen in FIGS. 16 and 17, providing hidden compartment 146.

From the foregoing, it is apparent that the objects of the invention are effectively achieved by each of the several described constructions, variations of which within the scope of the invention will also be apparent. In each case, a removable panel member covers one side of a compartment wherein relatively small articles may be concealed, thereby decreasing the possibility of their being stolen.

What is claimed is:

1. A furniture piece having at least one hidden compartment therein, said furniture piece comprising, in combination:

(a) frame means including supports for resting on a floor;

(b) a first wall fixed with respect to said frame and having an opening therein providing access to an interior space within said furniture piece;

(c) second and third walls fixed with respect to said frame and positioned within said interior space with facing, parallel surfaces spaced by a first, predetermined distance;

(d) a fourth wall fixed with respect to said frame and positioned within said interior space with a surface of said fourth wall perpendicular to and extending between said facing surfaces of said second and third walls;

(e) a pair of elongated, parallel grooves extending into the facing surfaces of said second and third walls to prespective bottom groove surfaces spaced by a second, predetermined distance, said grooves being parallel to and spaced equal distances from said fourth wall surface;

(f) a removable panel having a pair of parallel edges spaced by greater than said first distance and less than said second distance, whereby said panel may be positioned with said edges in said grooves to support said panel in spaced, parallel relation to said fourth wall with first and second surfaces of said panel respectively facing toward and away from said fourth wall surface, thereby forming a hidden compartment between the opposing surfaces of said fourth wall and said panel;

(g) handle means fixedly attached to said second panel surface for manual engagement as said panel edges are positioned in and removed from said grooves;

(h) a drawer slidably moveable into and out of said interior space with said removable panel remaining stationary in said grooves;

(i) said panel being positioned in a horizontal plane and providing a lower dust panel for said drawer;

(j) said handle means comprising an elongated member extending substantially the full distance between said pair of panel edges, perpendicularly thereto and centrally thereof, to provide a center guide for said drawer and including a forward end portion extending over a portion of said first wall; and (k) a screw head fixedly attached to the upper surface of said forward end portion, thereby giving the appearance that said drawer guide is fixedly attached to said first wall.

2. A furniture piece having at least one hidden compartment therein, said furniture piece comprising, in combination:

(a) frame means including supports for resting on a floor;

(b) a first wall fixed with respect to said frame and having an opening therein providing access to an interior space within said furniture piece;

(c) second and third walls fixed with respect to said frame and positioned within said interior space with facing, parallel surfaces spaced by a first, predetermined distance;

(d) a fourth wall fixed with respect to said frame and positioned within said interior space with a surface of said fourth wall prependicular to and extending between said facing surfaces of said second and third walls;

(e) a pair of elongated, parallel grooves extending into the facing surfaces of said second and third walls to respective bottom groove surfaces spaced by a second, predetermined distance, said grooves being parallel to and spaced equal distance from said fourth wall surface;

(f) a removable panel having a pair of parallel edges spaced by greater than said first distance and less than said second distance, whereby said panel may be positioned with said edges in said grooves to support said panel in spaced, parallel relation to said fourth wall with first and second surfaces of said panel respectively facing toward and away from said fourth wall surface, thereby forming a hidden compartment between the opposing surfaces of said fourth wall and said panel.

(g) handle means fixedly attached to said second panel surface for manual engagement as said panel edges are positioned in and removed from said grooves;

(h) spring means fixedly attached to said furniture piece within said interior space, said spring means being constructed and arranged to exert a bioasing force urging said panel member to a predetermined position with respect to said second and third walls;

(i) a removable shelf and means for supporting said shelf within said interior space; and (j) said handle means comprising a strip fixedly attached to said second surface of said panel and forming a portion of said shelf supporting means.

* * * * *